United States Patent [19]

Gammon

[11] Patent Number: 4,488,473

[45] Date of Patent: Dec. 18, 1984

[54] FLUID-ACTUATED RAM

[75] Inventor: Jimmie L. Gammon, Fairfield, Ill.

[73] Assignee: Liquid Power, Inc., Fairfield, Ill.

[21] Appl. No.: 348,202

[22] Filed: Feb. 12, 1982

[51] Int. Cl.[3] ..... F01L 15/02

[52] U.S. Cl. ..... 91/50; 91/275; 91/305; 92/37; 92/42; 92/44

[58] Field of Search ..... 92/39, 37, 43, 48, 44, 92/34, 42, 45; 91/275, 306, 305, 50; 417/472, 473

[56] References Cited

U.S. PATENT DOCUMENTS

| | | | |
|---|---|---|---|
| 970,284 | 9/1910 | Wilkins | 92/45 |
| 1,045,791 | 11/1912 | Hodge | 92/45 |
| 1,109,499 | 9/1914 | Zierden | 92/45 |
| 1,554,332 | 9/1925 | Callow | 92/90 |
| 1,745,959 | 2/1930 | Steiner | 92/44 |
| 2,021,156 | 11/1935 | Smith | 417/472 |
| 2,096,066 | 10/1937 | Saforcada | 137/156.5 |
| 2,747,510 | 5/1956 | Von Seggern | 417/480 |
| 2,780,066 | 2/1957 | Tarry | 60/60 |
| 2,811,925 | 11/1957 | Crookston | 103/44 |
| 3,354,832 | 11/1967 | Graham et al. | 92/45 |
| 3,401,607 | 9/1968 | Wortman | 92/42 |
| 3,974,744 | 8/1976 | Hedger | 92/34 |
| 4,111,616 | 9/1978 | Rankin | 417/480 |
| 4,249,376 | 2/1981 | Weckerly | 91/50 |

FOREIGN PATENT DOCUMENTS

| | | | |
|---|---|---|---|
| 213298 | 2/1958 | Australia | 92/47 |
| 507471 | 9/1930 | Fed. Rep. of Germany | 92/45 |
| 521260 | 3/1955 | Italy | 92/42 |

*Primary Examiner*—William R. Cline
*Assistant Examiner*—Randolph A. Smith
*Attorney, Agent, or Firm*—John E. Reilly

[57] ABSTRACT

A working head is adapted to impart reciprocal motion under a predetermined amount of force to a plunger through a working and return cycle and at a controllable rate of speed. A fluid circuit includes delivery and return lines extending between a source of fluid under pressure and the working head, and pilot control means associated with the fluid pressure source is operative to regulate the working and return cycle. The working head has a plurality of annular flexible casings of toroidal configuration with opposite sidewalls terminating in mutually opposed, inner bead-like edges and interconnecting means extending between the edges of adjacent casings serve to interconnect the casings in sealed, coaxially spaced relation to one another. Closures at opposite ends of the plurality of casings define a common sealed chamber therebetween. A support member fixes one end of the chamber against movement and permits axial expansion and contraction of the opposite end of the chamber with respect to the fixed end. The plunger is mounted to follow the movement of the opposite end of the chamber as the chamber undergoes expansion and contraction in response to the delivery and return of fluid under pressure to and from the chamber through the delivery and return lines.

14 Claims, 7 Drawing Figures

FLUID-ACTUATED RAM

This invention relates to fluid-actuated rams and more particularly relates to a novel and improved working head for a fluid-actuated ram of the type which is hydraulically actuated or powered for reciprocation of a working member, such as, a plunger in a pump or hydraulic press.

BACKGROUND AND FIELD OF THE INVENTION

It is customary to employ a bellows or diaphragm as a means for fluid displacement, especially in displacing or pumping fluids which contain solid matter or are in slurry form. In the construction of the bellows, inflatible tire casings have been employed in the past and, for example, a representative approach is illustrated in U.S. Pat. No. 1,554,332 to Callow wherein a bell crank is utilized to expand and contract a tire casing for the successive intake and discharge of fluid to and from the casing. Other patents of interest in this respect are U.S. Pat. Nos. 2,096,066 to Saforcada; 2,780,066 to Tarry; and 2,811,925 to Crookston, all of which disclose other representative types of diaphragm pumps.

Lift or suction pumps employed in the production of oil and gas on the other hand typically employ some form of walking beam with a bell crank at one end to reciprocate a plunger rod or piston in creating the necessary lift to recover oil. Other types of motor drives for reciprocal working members or plungers have been devised for metal working or forming operations as well as for lift pumps. To the best of my knowledge, however, no one has previously devised a satisfactory method and means of employing a series of stack or toroidal diaphragms or tire casings which will satisfactorily function as a working head and force amplifier in regulating both the force and rate of reciprocation of a plunger or piston rod and specifically in such a way as to minimize horsepower requirements and avoid the use of complex gearing, pitmans, cams and other mechanical means. The use of a toroidal diaphragm assembly of the type herein proposed has been found to offer a number of advantages over the prior art when used as a working head for a ram or plunger in regulating the amount of force, variation in length of stroke and rate of reciprocation in performing useful work.

SUMMARY OF INVENTION

It is therefore an object of the present invention to provide for a novel and improved working head for a ram or other type of reciprocal plunger or piston member which is highly efficient and dependable in operation, employs a minimum number of parts and is closely controllable in regulating the amount of force, length and rate of stroke while maintaining extremely good balance during speed and load changes thereon.

Another object of the present invention is to provide for a hydraulic working head in the form of a multi-toroidal bellows or diaphragm for plunger pumps which is capable of developing extremely long strokes and rapid cycle rates in relation to the well diameter and volume of fluid to be pumped.

A further object of the present invention is to provide for a working head for rams or other reciprocal members which operates both as an energy accumulator and force amplifier in controlling the reciprocation of the ram, the working head being so constructed and arranged as to minimize acceleration forces and shock loss throughout the entire mechanism while greatly reducing the wear and minimizing maintenance and operational costs.

In accordance with the present invention, a working head is adapted to impart reciprocal motion under a predetermined amount of force to a plunger or ram through a working and return cycle and at a controllable rate of speed. A fluid circuit includes delivery and return lines which extend between a source of fluid under pressure and the working head, and pilot control means associated with the fluid pressure source is operative to regulate the working and return cycle. The working head comprises a plurality of annular flexible casings, each of generally toroidal configuration with opposite sidewalls terminating in mutually opposed, inner bead-like edges; and interconnecting means extending between the inner bead-like edges of adjacent casings serve to interconnect the casings in sealed, coaxially spaced relation to one another with closure means at opposite ends of the plurality of casings to define a common sealed chamber therebetween. A support member fixes one end of the chamber against movement while permitting axial expansion and contraction of the opposite end of the chamber with respect to the fixed end, and the plunger is mounted to follow the movement of the opposite end of the chamber as the chamber undergoes expansion and contraction in response to the delivery and return of fluid under pressure to and from the chamber through the delivery and return lines.

The working head or sealed chamber as described has useful application in a number of areas where it is desirable to convert a high speed, rotary motion from a low horsepower source into relatively low speed reciprocating motion. For instance, in a chamber employing a series of four tire casings of a size on the order of 410-350-6 is capable of raising and lowering 1,000 lbs. nine times per minute with a low pressure centrifugal pump operated by ½ horsepower motor and delivering fluid under pressure at less than 25 lbs psi through a three-quarter inch line. The unit has useful application to lift pumps for pumping oil wells which require a perpendicular motion operating with variable length strokes and varied weight loads; also, it has useful application to production machinery utilizing more than one synchronized unit with variable thrust and pressure. The foregoing and other applications will become more readily understood and perceived from the following description of preferred and modified forms of invention.

With the foregoing and other objects in view, my invention comprises certain novel features of construction, combination and arrangements of parts and certain modifications as hereinafter described in detail and particularly set forth in the claims, reference being had to the accompanying drawings in which:

DETAILED DESCRIPTION OF THE PREFERRED EMBODIMENT

Figure 1:
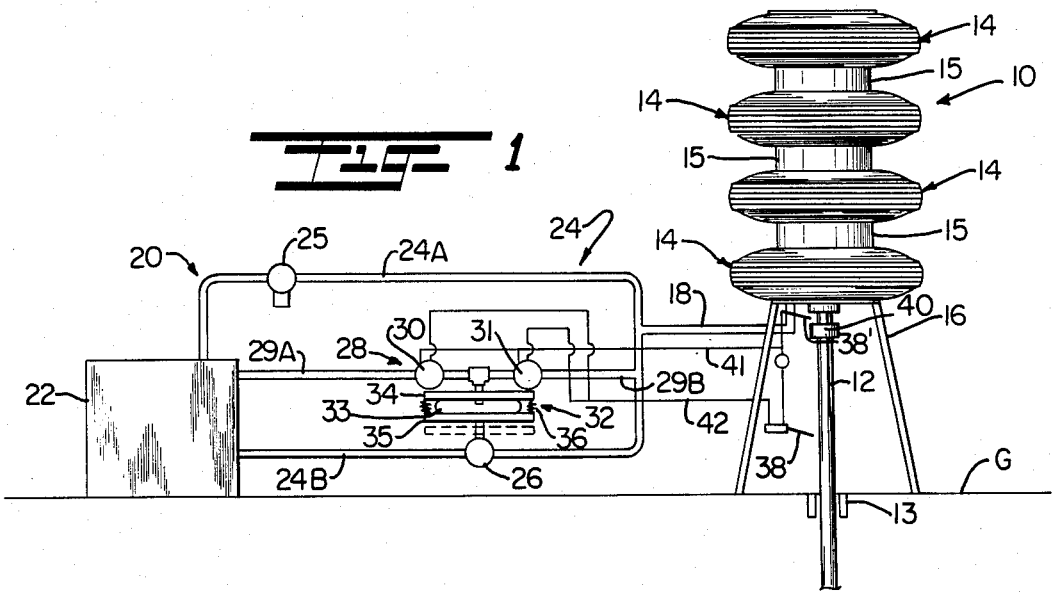
FIG. 1 is a front view in elevation of a preferred form of toroidal bellows arrangement in fully expanded position including a schematic illustration of one form of hydraulic control circuit for operating the bellows arrangement as a working head for a ram or other reciprocal member in a lift pump apparatus.

Referring in detail to the drawings, there is shown by way of illustrative example in FIG. 1, the utilization of a working head generally designated at 10 to control the reciprocation of a plunger rod or piston 12 as a part of a lift pump for a producing well. Typically, the plunger rod 12 extends through a pipe or casing string represented at 13 into a subsurface formation for the purpose of pumping oil therefrom in a conventional manner. In the relationship shown in FIG. 1, the working head comprises a series of tire casings 14 mounted in coaxial spaced relation to one another by spacers 15, the working head having its lower end supported on a stand 16 which is positioned on a ground surface designated at G. Fluid under pressure is delivered through intake/-return line 18 into the lower end of the working head to cause expansion of the tire casings to the relationship shown in FIGS. 1 and 2 and to cause the plunger 12 to be lifted or raised through the well casing 13; and when fluid is expelled from the working head 10 through the line 18, will contract the tire casings into the relationship shown in FIG. 3 as the plunger 12 is caused to be lowered through its return or downstroke.

The axial expansion and contraction of the working head 10 is regulated by a fluid control circuit 20 which, as schematically illustrated in FIG. 1, comprises a reservoir or tank 22 having a main conduit or loop 24 in communication with the delivery/return line 18. One side 24A of the loop 24 has a pump 25 for the purpose of pumping hydraulic fluid from the reservoir 22 through delivery line 18 into the lower end of the working head. Opposite side 24B of the conduit loop 24 is provided with check valve 26 which when opened will permit discharge or return of the fluid from the working head through the lower side 24B into the reservoir. Opening and closing of the check valve 26 is regulated by pilot control means 28 including a pilot control line 29 extending between the reservoir 22 and a pair of solenoid-operated pilot control valves 30, 31 which are connected in series in the pilot control lines 29A and 29B to regulate the delivery and discharge of hydraulic fluid into and from a pilot control chamber 32. Briefly, the control chamber 32 may be a toroidal-shaped diaphragm or tire casing similar to the casings 14 employed in the working head 10, the casing 33 being sealed between an upper fixed support plate 34 and a lower movable plate 35. Plate 35 is mounted on a valve stem member for the valve 26 so that, as fluid is directed into the control chamber causing its axial expansion, it will force the plate 35 downwardly to the dotted line position, as illustrated in FIG. 1, to effect closure of the check valve 26. When fluid is exhausted from the pilot control chamber, the movable plate 35 will be lifted by return springs 36 to cause the valve member to return the check valve to its open position. The direction of fluid flow into and from the pilot control chamber is again controlled by the pilot control valve 30 and 31 which are controlled by limit switches 38 and 38′ disposed in the path of movement of a collar 40 on the plunger 12. Here, the limit switches 38, 38′ are electrically connected to the valves 30, 31 through leads 41 and 42 in order to selectively energize or deenergize each of the valves.

When the working head is in its "down" position and the collar 40 trips the lower limit switch 38, valve 31 is opened and valve 30 is closed to cause fluid which is pumped by the pump 25 from reservoir 22 through the pilot control line 29B into the chamber 32 causing it to fill until the check valve 26 is closed so as to prevent any return flow of fluid through the loop 24. Once the valve 26 is closed, fluid is then pumped into the chamber, causing it to be raised to its expanded position, the upper limit of travel being determined by engagement of the collar 40 with the upper limit switch 38′. When the upper limit switch 38′ is tripped, the pilot control valves 30 and 31 are reversed so that valve 31 is closed and valve 30 is opened at which point the spring force 33 is sufficient to overcome any pressure resistance in the line 29A and fluid is discharged from the pilot control chamber 32 back into the reservoir. This will cause valve 26 to be opened so that fluid being pumped by the pump 25 through the upper side 24A will flow back around the lower side of the loop 24B as well as to induce the withdrawal of fluid from the working head. In other words, the return flow of fluid through the loop 24 will create a certain amount of suction tending to accelerate the withdrawal of fluid from the working head together with the natural tendency of the expanded bellows or casings 14 to contract when the pressure is reduced in the main conduit or loop 24.

The working head or toroidal bellows 10 is constructed and arranged to act as a low pressure energy accumulator and to directly translate the energy stored therein into the kinetic energy or force necessary to operate a relatively heavy workload. To this end, the work head 10 comprises the series of individual toroidal chambers or casings 14 interconnected by the annular rims 15 in sealed relation to one another so as to define a common chamber therebetween. Opposite ends of this chamber are sealed by upper and lower end plates 44 and 45, the lower end plate 45 having a port 46 for connection of the common line 18. As more specifically illustrated in FIGS. 2 and 3, each casing 14 is of toroidal configuration having an outer convex wall 50, mutually opposed sidewalls 51 terminating in inner bead-like edges 52. Preferably, each casing is composed of rubber or rubber-like material reinforced with a suitable cord or wire construction corresponding to that employed in the construction of a standard automobile tire, and particularly heavy duty truck tire casings. The inner bead-like edges or margins 52 accordingly may include a wire or cord reinforcing 52′ as employed in conventional tire constructions and which will facilitate the establishment of the necessary seal along the edges of the tire casings with the annular rims 15.

Figure 3:
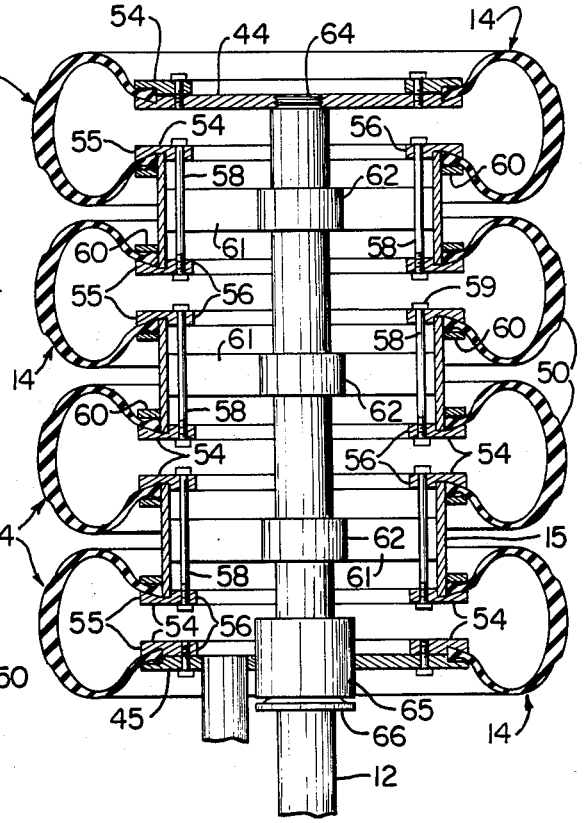
FIG. 3 is a vertical section of the preferred form of bellows illustrated in FIG. 2 shown in its contracted form.

Each annular rim 15 is of hollow, straight-walled cylindrical construction of a length to maintain at least a slight clearance or spacing between mutually opposed sidewalls 51 of adjacent tire casings when in the contracted position as illustrated in FIG. 3, the rims being sized to correspond to the inner diameters of the tire casings and terminating at each end in abutting relation to a spacer ring 54. Each spacer ring has a radially outwardly directed flange portion 55 which projects beyond the exterior surface of the rim 15 and an inner ring portion 56 provided with a series of bolt-receiving openings for insertion of lag bolts 58 which extend through aligned openings in the spacer rings at opposite ends of a common ring and are suitably secured together by nuts 59 so as to force the outwardly directed flange 55 of opposed spacer rings against the inner surfaces of the edges 52. Additionally, each rim is provided with a radially outwardly directed flange 60 in adjacent but spaced relation to each spacer ring 54 so as to form a common pocket or opening for reception of a bead or inner edge 52 in sealed relation therebetween.

In the preferred form of FIGS. 1 to 5, a plunger is adapted for insertion through the common chamber formed between the casings; and for this purpose, each rim 15 is supported by circumferentially spaced spokes or webs 61 which radiate outwardly from a central hub or sleeve 62 provided with an inner liner or bushing 63 through which the plunger rod 12 extends, the upper or distal end of the rod terminating in a threaded end portion 64 which is threadedly secured in the center of the end plate 44. The lower end plate 45 is correspondingly provided with a plurality of spokes 61', and a central hub 62' with inner lining 63' for slidable movement of the plunger therethrough, the hub 62' having a downwardly directed internally threaded cylindrical extension 65 for insertion of a packing gland 66 so as to effect the necessary seal at the lower end of the chamber with the plunger. Spacer rings 54 which correspond to those employed at opposite ends of the rim or rims 15 are similarly used in cooperation with the end plates 44, 45 and are bolted directly to the end faces of the plates 44 and 45 to establish the necessary sealed relationship between the end plates and opposite terminal edges of beads 52 of the upper and lowermost casings 14.

Figure 2:
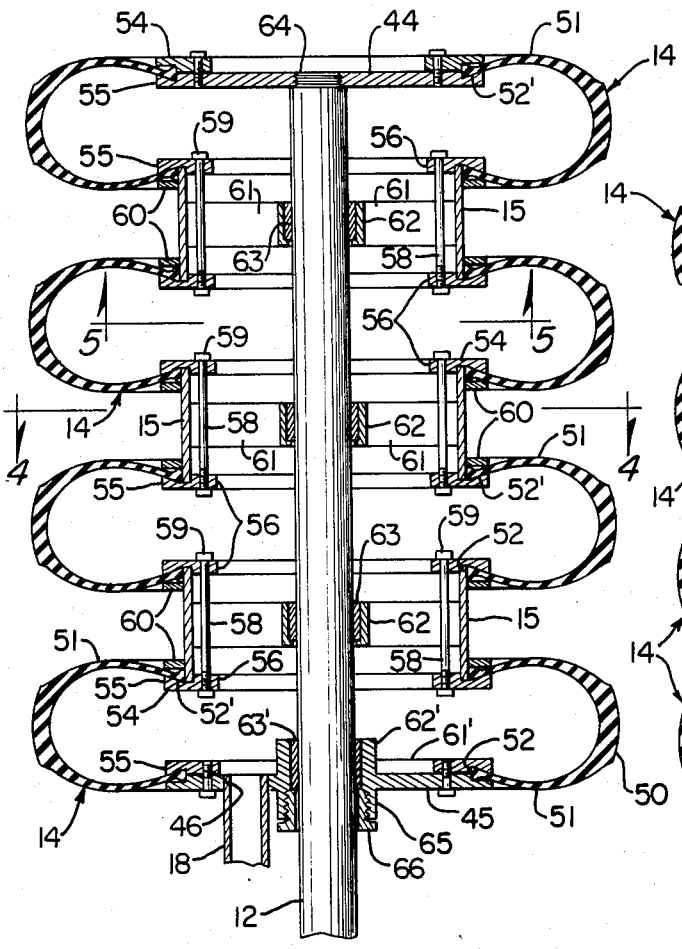
FIG. 2 is a vertical section view illustrating in more detail the construction and arrangement of the working head of the present invention when in its partially expanded form.

In practice, when the working head 10 is in its contracted or "down" position as shown in FIG. 3, at the completion of a cycle, the main control valve 26 will be in at least a partially open position, and the collar 40 on the plunger will have engaged the lower limit switch 38 so as to open the pilot valve 31 and close pilot valve 30. The motor drive source or pump motor 25 which, for example, may be a low pressure centrifugal pump is continuously running and will continue to deliver fluid under pressure through the upper end of the loop 24A. The degree of opening of the valve 26 is sufficient to establish some back pressure or resistance in the return line 24B; and some fluid remains in the working head 10 to create initial resistance to flow through the line 18 so that when the valve 31 is opened, fluid will flow through the line 29A of least resistance into the pilot control chamber 32 to act against the lower end plate 36 so as to close the valve 26, after which the fluid will flow directly into the working head 10 to raise it to the upper limit as illustrated in FIG. 2. At the upper limit of travel, the collar 40 will move into engagement with the upper limit switch 38' causing it to reverse the pilot valves 30 and 31 and to empty the pilot chamber into the reservoir 22 while opening the valve 26 to permit fluid to be exhausted from the working head. As previously described, the closed loop 24 will create a certain amount of suction tending to induce the discharge of fluid from the working head 10 coupled with the resiliency or urging of the sidewalls of the casing to return to their normally contracted state as shown in FIG. 3.

DETAILED DESCRIPTION OF MODIFIED FORMS OF INVENTION

Figure 6:
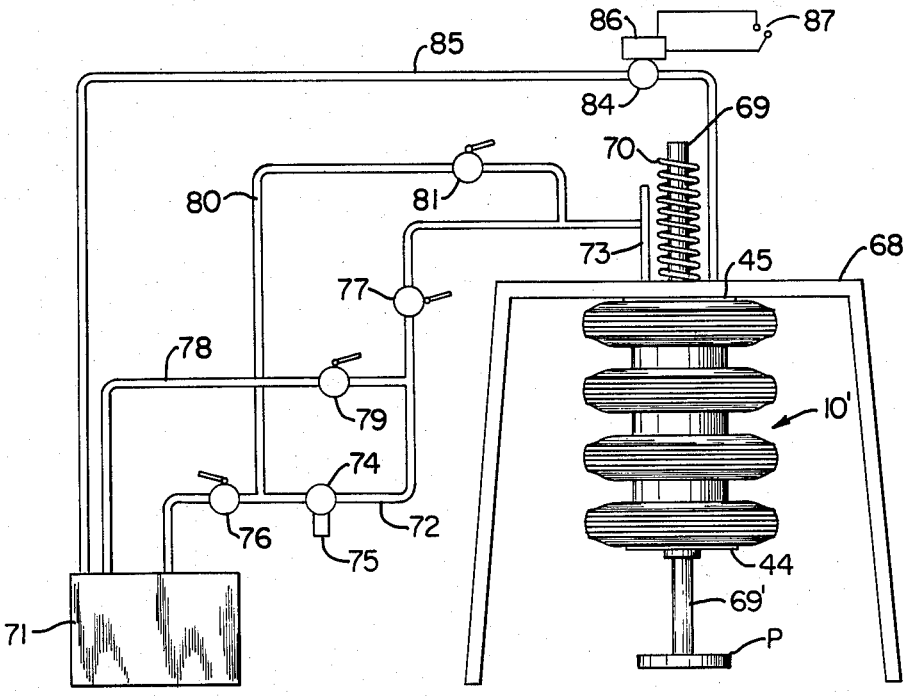
FIG. 6 is a front view of a modified form of working head employed in a hydroforming press and schematically illustrating a modified form of hydraulic control circuit.
Figure 5:
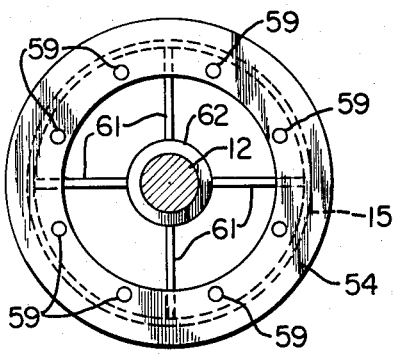
FIG. 5 is a cross-sectional view taken about lines 5—5 of FIG. 2.
Figure 4:
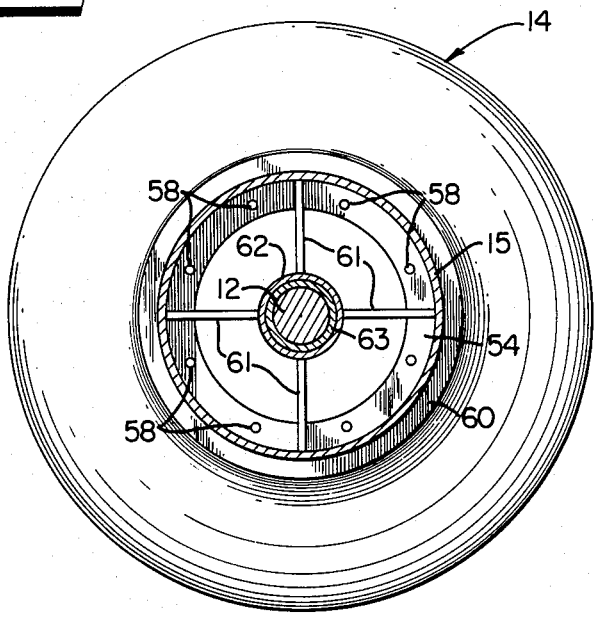
FIG. 4 is cross-sectional view taken about lines 4—4 of FIG. 2.

In the modified forms shown in FIG. 6, the working head 10' corresponds in construction to that of the working head 10 of the preferred embodiment but is reversed in its mounting such that the end plate 45 or intake end is mounted in fixed relation to the underside of an elevated support stand 68 with the working head 10' suspended downwardly from the support stand and the opposite end plate 44 being at the lower end of the working head assembly. Plunger or ram 69 extends through the working head and projects upwardly through the upper end plate while being fixed at its lower end to the end plate 44 in the same manner as illustrated in FIGS. 1 to 5. A coiled lift or return spring 70 is mounted on the upper exposed end of the plunger 69 to aid in returning the head 10' to its raised or contracted position at the end of each down or working stroke. A separate working member 69' projects downwardly from the lower end plate 44 and is provided with an enlarged head or press member designated at P at its lower extremity for the purpose of applying pressure to an object or workpiece to be formed. In this respect, the modified form of invention as illustrated in FIG. 6 is designed primarily for use as a hydroforming press, such as, for use in metal forming operations.

In the particular form of fluid control circuit 70 as illustrated in FIG. 6, a fluid reservoir 71 is filled with hydraulic fluid, and a delivery line or conduit 72 extends from the fluid reservoir to a common intake/discharge port as illustrated at 73. A first low pressure centrifugal pump 74 with its own motor drive 75 is positioned in the conduit 72, together with a first manual control valve 76 upstream of the pump 74 and a second manual control valve 77 downstream of the pump. A suction or return line 78 intercommunicates between the intake conduit 72 and the tank or reservoir 71 and has a manual control valve 79 adjacent to its junction with the intake line. An intermediate loop is formed in the delivery line 72 by a line 80 having a control valve 81 therein. In order to supplement fluid pressure applied to the working head by the pump 74, another booster pump 84 may be positioned in a separate delivery conduit 85 leading directly from the tank 71 to the upper end of the working head through a separate port, not shown, but corresponding to the intake discharge port of the preferred embodiment. The booster pump 84 includes its own motor drive 86 together with a manual or electrically controlled switch 87.

In normal use or operation, the control valves 79 and 81 are closed and control valves 76 and 77 are open, and the pump 74 is activated to deliver fluid under pressure into the working head 10' in order to expand it downwardly and cause the ram 69 to exert a downward pressure or force on an article to be formed or shaped. In order to reverse the cycle and to return the working head to its raised position, control valves 79 and 81 are open while closing valves 76 and 77, as a result of which the pump 74 will induce discharge of fluid from the working head 10 through the common port 73 through line 80 and back through return line 78 to the tank.

It will be evident that the operation of the control valves may be automatic, if desired, to establish both the desired length of stroke of the ram 69 and the cycle rate whenever it is desired to supplement the working pressure or force applied upon completion of the down or expansion stroke of the working head 10'. In order to accomplish same, control valve 77 is closed and valve 79 opened to establish a closed path for fluid from the pump 74 to and from the reservoir and prevent return flow from the working head 10. Booster pump 84 is then activated to deliver fluid independently to the working head through the line 85 and may be controlled manually or automatically independently of the operation of the main pump 74.

Figure 7:
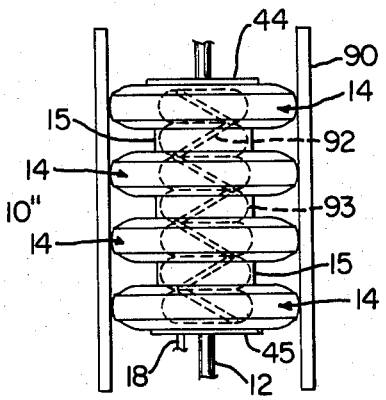
FIG. 7 is a view of a modified form of working head in accordance with the present invention.

In the modified form illustrated in FIG. 7, a working head 10'' corresponds in construction to that of FIGS. 1 to 5 and once again broadly comprises a plurality or series of casings 14 interconnected by spacers 15 with opposite end plates 44 and 45 and a central plunger or rod 12 extending centrally through the sealed chamber formed. However, in this form, the chamber is externally supported or reinforced by circumferentially spaced, vertical support rods 90 which, for example, may be affixed to the support stand for the common chamber and cooperates in maintaining precise alignment between the casings 14 as they undergo expansion and contraction. In this relation, a spirally extending, wire reinforcing designated at 92 is embedded in a flexible inner concentric diaphragm or sheath 93 which extends upwardly through the chamber. In this manner, at the completion of the expansion or lift phase of the cycle, the reinforcing 92 will as the fluid starts to empty from the chamber assist in accelerating contraction of the tires and discharge of the fluid from the chamber throughout the return or upstroke.

It is therefore to be understood that various modifications and changes may be made in the precise construction and arrangement of parts comprising the preferred and modified forms of invention as hereinbefore described without departing from the spirit and scope of the invention as defined by the appended claims.

I claim:

1. A fluid-actuated working head adapted to impart reciprocal motion under a predetermined force to a ram through a working and return cycle at a controllable rate of speed wherein delivery and return lines extend between a source of fluid under pressure and said working head, said working head comprising:

a plurality of annular flexible casings, each of generally toroidal configuration with opposite sidewalls terminating in mutually opposed, inner bead-like edges, interconnecting means extending between said inner bead-like edges of adjacent casings operative to interconnect said casings in sealed, coaxially spaced relation to one another, closure means at opposite ends of said plurality of casings defining a common sealed chamber therebetween, support means fixing one end of said chamber against movement as said chamber undergoes axial expansion and contraction with respect to said fixed end, and said ram mounted to follow the movement of said opposite end of said chamber as said chamber undergoes expansion and contraction in response to the delivery and return of fluid under pressure to and from said chamber through said delivery and return lines, said ram defined by a plunger extending through said chamber for connection to said opposite end of said chamber, and centering means associated with said interconnecting means through which said ram is inserted whereby to center said plunger for axial movement centrally through said chamber in response to expansion and contraction of said chamber; and a fluid control circuit characterized by having a pump in said delivery line for delivery of fluid under pressure from said fluid pressure source to said chamber, and pilot control means operative to regulate delivery and return of fluid under pressure to and from said chamber, said delivery and return lines including a main conduit in the form of a loop, a common conduit extending from said loop for connection to said chamber, and said pilot control means including a conduit extending between said loop and said fluid reservoir.

2. The working head according to claim 1, said interconnecting means having annular rigid cylinders extending between said inner edges of adjacent casings.

3. The working head according to claim 1, said interconnecting means defined by annular rigid cylinders extending between said inner edges of adjacent casings, and outwardly directed, spaced flanges on said cylinders disposed in sealed relation to said inner edges.

4. The working head according to claim 1, said chamber imparting a working stroke to said ram upon contraction of said chamber and imparting a return stroke to said ram upon expansion of said chamber.

5. The working head according to claim 1, said interconnecting means operative to maintain a uniformly spaced relationship between said casings as said casings undergo expansion and contraction in response to the delivery and return of fluid under pressure to and from said chamber.

6. The working head according to claim 1, said fluid pressure source being a hydraulic fluid reservoir.

7. The working head according to claim 3, said casings each being in the form of an inflatable tire composed of a reinforced rubber or rubber-like material, each of said centering means including a central busing in inner spaced concentric relation to said cylinder, and said ram disposed for slidable movement through said busings, one end of said ram fixed to said movable end of said chamber.

8. A fluid-actuated working head adapted to impart reciprocal motion under a predetermined force to a ram through a working and return cycle in which a fluid control circuit has delivery and return lines extending between a source of fluid under pressure and said working head, said working head comprising:

a plurality of annular flexible tire casings arranged in a vertical stack, each casing of generally toroida configuration with opposite sidewalls terminating in mutually opposed, annular edges, spacer means extending between said annular edges of adjacent casings operative to the interconnect said casings in sealed, coaxially spaced relation to one another, and end closure means at opposite, upper and lower ends of said plurality of casings defining a common sealed chamber therebetween, a support stand fixing the lower end of said chamber against movement as said chamber undergoes axial expansion and contraction with respect to said lower end, said ram extending through said working head and having its upper end fixed to said upper end of said chamber so as to follow the movement of said upper end of said chamber as said chamber undergoes expansion and contraction in response to the delivery and return of fluid under pressure to and from said chamber through said delivery and return lines; and said fluid control circuit characterized by having a pump in said delivery line for delivery of fluid under pressure from said fluid pressure source to said chamber, a check valve in said return line, and pilot control means operative to control opening and closing of said check valve to regulate delivery and return of fluid under pressure to and from said chamber, said delivery and return lines including a main conduit in the form of a loop, a common conduit extending from said loop for connection to said chamber, and said pilot control means including a conduit extending between said loop and said fluid reservoir.

9. The working head according to claim 8, said spacer means having annular rigid cylinders extending between said annular edges of adjacent casings, and outwardly directed, spaced flanges on said cylinders disposed in sealed relation to said annular edges.

10. The working head according to claim 8, said fluid pressure source being a hydraulic fluid under pressure.

11. The working head according to claim 8, said pilot control means including a pilot control chamber having a flexible diaphragm, pilot control valves in said pilot control conduit on opposite sides of said pilot control chamber, said check valve responsive to expansion of said pilot control chamber to close said return line between said chamber and fluid reservoir.

12. The working head according to claim 11, including limit stop means associated with said ram to selectively open and close said pilot control valves in response to movement of said ram through each working and return cycle.

13. The working head according to claim 8, said ram defined by a plunger extending through said chamber for connection to said opposite end of said chamber, and centering means associated with said interconnecting means through which said ram is inserted for axial movement centrally through said chamber in response to expansion and contraction of said chamber.

14. The working head according to said 13, said chamber imparting a working stroke to said ram upon contraction of said chamber and imparting a return stroke to said ram upon expansion of said chamber.

* * * * *

UNITED STATES PATENT AND TRADEMARK OFFICE

CERTIFICATE OF CORRECTION

PATENT NO. : 4,488,473

DATED : December 18, 1984

INVENTOR(S) : Jimmie L. Gammon

It is certified that error appears in the above—identified patent and that said Letters Patent is hereby corrected as shown below:

Column 8, line 35 (claim 7) cancel "busing" and substitute -- bushing --.
Column 8, line 38 (claim 7) cancel "busings," and substitute -- bushings, --.
Column 8, line 47 (claim 8) cancel "toroida" and substitute -- toroidal --.
Column 8, line 51 (claim 8) cancel -- the --.

Signed and Sealed this

*Thirtieth* Day of *April 1985*

[SEAL]

*Attest:*

DONALD J. QUIGG

*Attesting Officer* *Acting Commissioner of Patents and Trademarks*